United States Patent [19]

Flaig et al.

[11] 4,102,120

[45] Jul. 25, 1978

[54] ELECTRONIC ALARM CLOCK WITH A SERVICING ARRANGEMENT FOR TIME ADJUSTMENT

[75] Inventors: Hans Flaig; Friedrich Assmus, both of Schramberg, Germany

[73] Assignee: Gebruder Junghans GmbH, Schramberg, Germany

[21] Appl. No.: 704,829

[22] Filed: Jul. 13, 1976

[30] Foreign Application Priority Data

Jul. 26, 1975 [DE] Fed. Rep. of Germany ..... 7523854

[51] Int. Cl.[2] ..... G04C 9/00; G04C 21/12

[52] U.S. Cl. ..... 58/38 R; 58/85.5

[58] Field of Search ..... 58/14, 16 R, 16 D, 19 R, 58/23 R, 38 R, 50 R, 152 B, 85.5

[56] References Cited

U.S. PATENT DOCUMENTS 3,919,834 11/1975 Murakami et al. ..... 58/14

*Primary Examiner*—Stanley J. Witkowski

*Attorney, Agent, or Firm*—Burns, Doane, Swecker & Mathis

[57] ABSTRACT

An electric alarm clock includes a digital display mechanism and an alarm device. First and second individually actuable switches are connected to master circuitry of the clock. The first switch is operable to select types of wake-up displays, such as hours, minutes, etc. for adjustment. The second switch is operable to select types of time-of-day displays, such as hours, minutes, etc. for adjustment. A switching mechanism is provided for gating-in the wake-up time on the display mechanism in response to actuation of the first swtich and/or the alarm control switch.

8 Claims, 3 Drawing Figures

ELECTRONIC ALARM CLOCK WITH A SERVICING ARRANGEMENT FOR TIME ADJUSTMENT

BACKGROUND AND OBJECTS

The innovation concerns an electronic alarm clock with a servicing or adjusting arrangement for the time adjustment and with a circuit with a time of day counter as well as with a storage for the time of a waking-up alarm and a triggering circuit, made especially by way of integrated technique, furthermore with a digital display arrangement for a continuous display of the time of day as well as a selective gating of a wake-up time at the same place, whereby a manually operable selective switch has been provided for the selection of the part or type of display wake-up time or time of day, as well as with a triggering switch for the adjustment or correction of the momentary display of the individual parts or places of display, hours and minutes and, in addition, a turn-off for the alarm signal.

As a result of a first proposed watch in German OS 2,302,978, a digital display wrist watch has been disclosed which can be used as a time display device and, in addition, as a stop watch or as an alarm clock. In the following, however, we will enter only into more detail with regard to the additional function as an alarm clock. This wrist watch has as a display mechanism a customary seven-segment liquid crystal arrangement for the presentation of hours and minutes. A corresponding integrated electronic control has been disposed in the inside of the housing. As servicing elements there are provided: two triggering switches for altering or adjustment of the hour and minute recording, a sliding change-over switch for the selection of either the time of day (existing time) or of the time of waking up (alarm time) for alteration, as well as a turn-off button for the alarm signal.

The adjustment of the waking up time, as well as the time of day, is accomplished by way of the two triggering switches for the places of displaying the hours and the minutes. The kind of display to be adjusted, i.e., existing time or alarm time, is preselected by shifting the previously mentioned sliding change-over switch and by gating, i.e., displaying at the same time the corresponding waking-up time or time-of-day on the display field.

Beside the previously described watch and its servicing arrangement, there exist, especially in the case of watches with selective displaying of the time of day and the date, very different switching and pressure key arrangements. In this connection, we should like to mention a second German OS 2 319 437 which has likewise for its object an electronic watch. This watch has a digital display arrangement with which the date, the day, the hour, the minute and the second are displayed. As an operating element there has been provided first, a correcting switch for correction of the display and second, a selecting switch for selection of a certain display place or position, which is to be corrected at any time. In addition, there is a safety switch which will prevent unintentional operation of one of the two switches and thus any effect on the display. Whenever the safety switch is released, then by repeated pressing of the selecting switch, a desired place of the display can be selected. The place selected each time has been characterized or indicated by a flicker rhythm. If now the correcting switch is also pressed simultaneously, then the selected place of display, or its display value, or symbol can be changed.

A third proposed watch (German AS 2,238,827) has an electronic correction for the time and date recording. Merely a rotary switch has been provided for the above mentioned function, which switch can be rotated into several positions. The individual positions, namely a starting position, a zero position for seconds, a correcting position for hours and a correcting position for dates, are the possible functional positions. If they are selected by the rotary switch, then corresponding correction of the recording can be carried out without operating any additional switches, after a short period of delay.

The disclosures of the above mentioned patents are hereby incorporated herein by reference.

The prior art servicing arrangements for the adjustment or correction of a digital display for electronic clocks or watches have various disadvantages. In a case where the determining of whether the time-of-day or alarm time representation is to be displayed for correction depends solely upon the positioning of a sliding change-over switch, the wrong representation will unintentionally be changed if the operator forgets to position the change-over switch properly. In a complicated arrangement wherein a predetermined number of repeated pressings of a switch for selecting the particular place or digit of the display conditioned for change or correction, an error can easily be made in the place or digit selected. Where positioning of a rotary switch determines which of, for example, three display places or digits is subjected to correction, the movable arm of the switch must be moved over a first contact on one side of the neutral position, without acting through that contact, in order to reach the second contact on the same side of neutral. In this latter case, poor reaction or carelessness of the operator can result in unintentional operation through the contact to be passed over.

Therefore, it is an object of the present invention to create a servicing or adjusting arrangement for an electronic watch with digital recording in which disadvantages of the prior art arrangements will be avoided. The servicing arrangement of the invention a simple provides and uncomplicated handling of the individual servicing elements on the basis of an unequivocal functioning assignment, so that mistakes in servicing will be precluded to the farthest possible extent.

BRIEF DESCRIPTION

These objects are achieved in accordance with the present invention by an electric alarm clock of the type including a digital display mechanism, an alarm device and a master circuit. The master circuit includes an integrated control circuit having a counter for the time-of-day connected to the display mechanism. Also provided are means for storing a wake-up alarm time, and means for comparing the wake-up alarm time to the time-of-day connected to the alarm device to activate the latter. A main circuit connects the counter and the display mechanism. A gating-in circuit connects the control circuit to the display mechanism for gating-in the wake-up alarm time to the display mechanism. A manually operable selecting switch arrangement is included in the master circuit for selecting a type of display to be adjusted. A manually actuable alarm control switch is provided for deactuating the alarm device. A manually actuable triggering switch is connected to the master circuit for adjusting the part or type of display selected by the selecting switch arrangement. The selecting switch arrangement comprises first and second individually actuable switches. The first switch is connected for selecting types of wake-up alarm displays, such as hours, etc., for adjustment. The second switch is connected for selecting types of time-of-day displays such as hours, etc., for adjustment. The first and second switches are independently shiftable into various stop positions for selecting the type of display to be adjusted. The triggering switch, when actuated, is operable to adjust the value of a display selected by either of the first and second switches.

THE DRAWING

In the following pages, a preferred embodiment of the invention has been described on the basis of the accompanying drawing in which.

DETAILED DESCRIPTION

Figure 1:
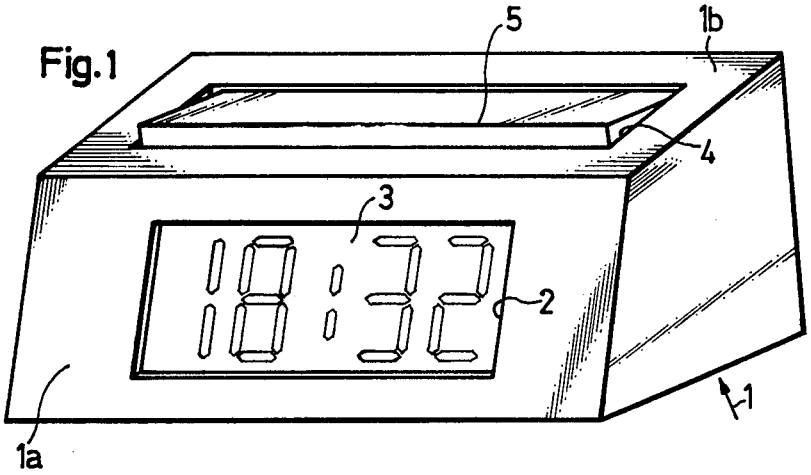
FIG. 1 shows a front view of an embodiment of an alarm clock with a digital display.

In the case of the preferred alarm clock according to the invention shown in FIG. 1, the numeral 1 designates a housing, and 2 a display field disposed on the front side 1a of the housing. A digital display mechanism 3 is visible in the display field 2, which makes possible a display of hours and minutes - possibly also of seconds. The recording mechanism 3 is formed by liquid crystal elements in the form of a seven-segment display operated through a usual decoder, the construction of which mechanism is well known in the art (see for example in German OS 22 06 592), and therefore has not been specially explained. An opening 4 has been provided in the cover surface 1*b* of the housing of the alarm clock, which surface 1*b* is slightly slanting forward. An alarm control or turn-off switch 5 for the alarm signal has been mounted moveably in the opening 4 in the form of a tilting bar. The turn-off 5 for the alarm signal can assume five positions, as will only be explained in more detail on the basis of FIG. 3.

Figure 2:
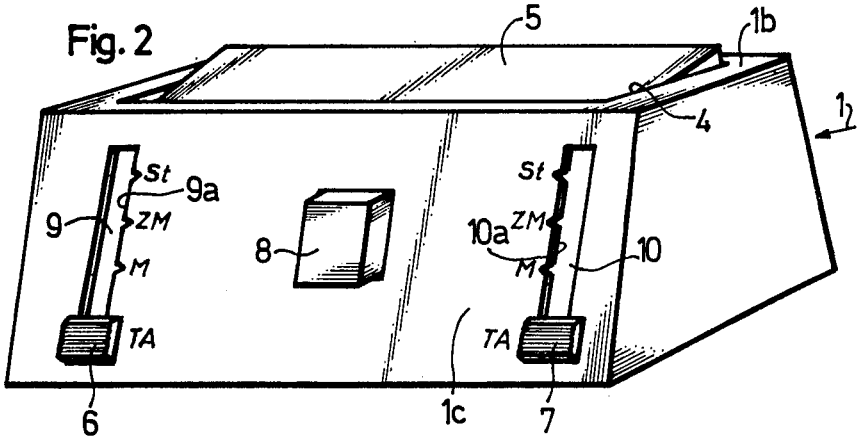
FIG. 2 is a rear view of an alarm clock with the servicing arrangement according to the invention.

In FIG. 2, which depicts the rear side 1*c* of the alarm clock, all servicing elements of the alarm clock are visible. Beside the turn-off 5 for the alarm signal on the cover surface 1b, there are provided, on the rear surface 1*c*, a pair of selecting switches in the form of an adjusting lever 6 for the time-of-day, and an adjusting lever 7 for the wake-up or alarm time. Also provided is a triggering switch 8. The two adjusting levers 6 and 7 are to be operated independently of one another and have been developed in each case as slide switches with a handle that can be operated from the outside. In the inside of the alarm clock housing 1, a switching mechanism, conventional and not shown in any detail, has been connected to each handle through an elongated hole 9 or 10 in the rear side 1c. Various stop depressions with the designations TA, M, ZM and St alongside, have been formed on one longitudinal side 9a or 10*a* of the elongated holes 9 or 10. At the same time, the individual designations stand for the following meaning in each stop position:

TA = display of time of day
M = place for the display of unit digit of minutes
ZM = place for the display of tens digit of minutes
St = place for the display of hours.

Whenever now the adjusting levers 6 and 7 are in the stop position designated by TA, then the contact path between the control circuit IC and the display mechanism 3 is closed and the time of day is displayed. The position TA corresponds to the basic position of the adjusting levers 6 and 7 from which they can be shifted into a different position for the purpose of adjusting or correcting the pertinent display and from which they can be shifted back again. The other stop positions of the two adjusting levers are purely selective positions. Whenever the adjusting lever 6 for the time-of-day is shifted from the base position (TA) into a position St, ZM or M, then the display place or position, which is to be corrected or adjusted, will thereby be selected. Whenever a triggering switch 8 is pressed, then a main switch between the control circuit IC and display mechanism 3 is closed, and the pertinent preselected recording place St, ZM or M is corrected or adjusted. The triggering switch 8 is a pressure or spring biased key or button which, upon release from the depressed position, returns immediately again into its starting position and, as a result of that, will again open the main circuit between the control circuit IC and the recording mechanism 3 and abruptly interrupt the correcting process.

Figure 3:
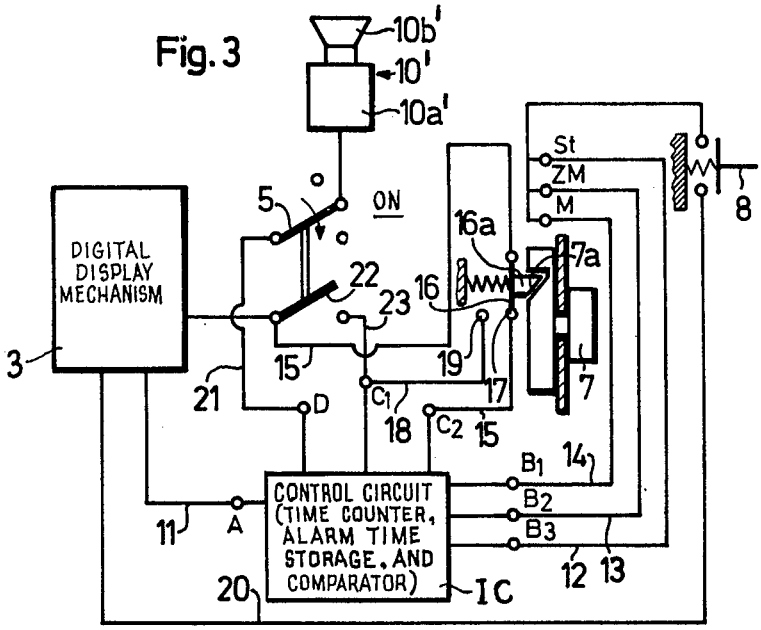
FIG. 3 is a schematic presentation of the pertinent electric connections from the individual servicing elements to the control circuit IC or to the display and signal or alarm arrangement.

The master circuit including the connections between the triggering switch 8, the adjusting lever 7 for the wake-up alarm time and the turn-off 5 of the alarm signal, the control circuit IC, the recording display mechanism 3 and the signaling arrangement 10' have been described in the following paragraphs on the basis of FIG. 3. In this schematic presentation of the master circuit, the adjusting lever 6 for the time-of-day as well as its series connection have not been shown for the sake of clarity.

In the case of control circuit IC, it is a customary integrated electronic circuit with a counter mechanism, a storage for the wake-up alarm time, a comparator circuit for the wake-up alarm time, as well as a triggering circuit for the display mechanism.

Such control circuitry is well known in the art, as exemplified by the afore-referenced German AS 2,206,592. Such circuitry may thus include a pulse generator continuously driving a series of dividers to provide therein counts including representations of tens of seconds, minutes, tens of minutes, hours and tens of hours, respectively, corresponding to the time of day. A series of storage or memory units are provided along with an arrangement for setting them to counts representative of tens of seconds, minutes, tens of minutes, hours and tens of hours, respectively, corresponding to the time at which operation of the alarm is desired. The dividers may be connected through decoder circuits to digital display units of the seven bar display type for displaying the counts for the respective time units so that the time of day is displayed. The display units may be temporarily switched to the storage units for display from those units while the alarm time is being set or when it is desired to check the time which has already been set. Comparator circuits can be provided to compare the counts in the dividers and storage units for each corresponding unit of time and, when each compared count corresponds, to provide a signal to activate a driving circuit for sounding an alarm through a buzzer or a minature speaker. Some or all of the circuitry employed may be in the form of integrated circuits.

A customary reinforcing circuit or amplifier 10a' and a signal or sound generator 10b', as an electronic buzzer, have been provided as a signaling arrangement 10'. The aforementioned German Patent document OS 2,206,592 also demonstrates that these elements are well known in the art by showing a buzzer operated from a driving circuit, which is controlled by the comparator circuitry and which may consist of an amplifier.

In the master circuit, of the total number of exits output terminals from the control circuit IC, only seven (7) have been shown in the drawing. A first supply line or main circuit 11 is connected with exit terminal A from the counter mechanism and leads to the display mechanism 3. The exits $B_1$, $B_2$, $B_3$ are connected on the one hand with the counter mechanism of the control circuit; on the other hand, they are connected to supply lines 12, 13, 14 leading to series contacts corresponding to the stop positions St, ZM and M in the series shifting path of the adjusting lever 7 for the wake-up time. The second supply line 15 to the display mechanism 3 is connected with the terminal $C_2$ of the control circuit IC. In the supply line 15, a change-over switch 16 has been disposed which is operated by the adjusting lever 7 and which in its normal position keeps the supply line 15 closed via the contact 17, so that the time of day is display continuously on the recording display mechanism. The terminal $C_1$ is connected on the one hand with the storage for the wake-up alarm time of the control circuit IC; on the other hand a connecting line 18 leads therefrom to a contact 19 of the other contact position of the change-over switch 16. Whenever the change-over switch is shifted by shifting of the adjusting lever 7 for the wake-up alarm time from the base position (TA) from the contact 17 to the contact 19, then the supply line 15 to the display mechanism 3 for displaying the time of day is interrupted or overridden, and the wake-up alarm time is gated in on the display mechanism. In that event, the corresponding connection of the control circuit IC and recording mechanism comprises a gate-in circuit leading from terminal $C_1$ of the control circuit IC via the connecting line 18, the change-over switch 16 switched-over to the contact 19 and the supply line 15 to the display mechanism.

The change-over switch 16 is developed such that it can be shifted by means of a cam 16a and platform 7a, molded onto the adjusting lever, from its normal position, away from contact 17. A compression spring will then accomplish the return of the change-over switch 16 into this normal position, whenever the adjusting lever 7 has again been brought into its base or normal position TA. Whenever the change-over switch 16 is changed to the contact 19 and whenever the adjusting lever 7 is shifted further in a vertical direction to the stop position St, ZM and M, then on the one hand the conductors $C_1$, 18 and 15 remain closed, i.e., the display for the wake-up alarm time remains gated in on the display mechanism. On the other hand, each time one of the series contacts corresponding to the pertinent stop positions St, ZM and M is closed, then the display place for the wake-up alarm time has been preselected. That is, if the lever 7 is shifted to M, then the existing wake-up alarm time is displayed on the display mechanism 3, and the place for the displaying of minutes for the wake-up time can be adjusted by pressing the triggering switch 8. The previously-mentioned series contacts are only shown as points in the drawing, since in the present case they can be operated perpendicularly in relation to the plane of the drawing. An additional supply line 20 to the recording mechanism 3, which can be closed by the triggering switch 8, connects the closed series contacts corresponding to the preselected stop positions St, ZM and M with the pertinent display place or position of the recording of the alarm signal. Whenever the triggering switch 8 is pressed, then the wake-up alarm time can be adjusted.

The terminal D of the control circuit IC is connected on the inside with the comparator circuit for the wake-up alarm time; a line 21 leads from the terminal D to an amplifier circuit 10a' for the alarm signal and by way of this to an alarm signal generator 10b'. Between the amplifier circuit 10a' and the terminal D of the control circuit IC is connected to the turn-off switch 5 for the alarm signal. Whenever the latter is in the position marked by "on", then the signaling arrangement is switched on, and whenever the counter value for the time of day and the stored wake-up alarm time that is to be compared in control circuit IC, correspond alarm signal 10' is triggered. Whenever the turn-off 5 for the alarm signal is pressed in the direction of the arrow, then the alarm signal is interrupted. Upon reaching a switching position designated with "end", the alarm signal is turned off completely. If the alarm is to remain turned off permanently, then the alarm signal generator 10b' can be interrupted permanently by moving the turn-off 5 for the alarm signal into the stop position designated with "off". It will however be possible to gate-in the adjusted wake-up alarm time on the display mechanism 3 instead of the time of day by means of the turn-off for the alarm signal, but utilizing the same path as in the case of turning off of an alarm signal, starting out from the position of the ready position for the alarm "on". For this purpose, a switch 22 has been rigidly connected with the turn-off 5 for the alarm signal. Whenever now the turn-off for the alarm signal (without sounding an alarm signal) is pressed down in the direction of the arrow, then the stored wake-up alarm time is gated-in on the recording arrangement by way of the terminal $C_1$ of the control circuit IC and an additional supply line 23. The turn-off 5 is biased away from such a position, so in the case of the turn-off 5 of the alarm signal in that instance, we are dealing with a pressure key momentarily arrested in the "off" position. Thus, the gated-in wake-up alarm time, upon releasing the turn-off 5 for the alarm signal, disappears instantaneously and in the same place the time of day is again display continuously.

In view of the previously described embodiment, we should state that the circuit assignment of the individual stop positions of the adjusting levers 6 and 7 are the result of the particular structure of the control circuit IC.

Instead of having a switch 22, it would also be possible to arrange a portion of the turn-off switch 5 so that the change-over switch 16 is located in its path of movement. Thus, when the switch 5 is shifted to a predetermined position, it would acuate the switch 16 much in the same fashion as the lever 7 to gate the wake-up time onto the display field.

It would also be conceivable that with a different control circuit IC, a change of the ten minute position might not be possible. In that case, the stop positions ZM of the two adjusting levers 6, 7 and the pertinent series contacts would be omitted. However, there also are control circuits which make possible the ability to stop the continuous displaying of the time instead of the correction of the ten minute positions. This will permit an adjustment of the time precise to the seconds, since the depressed triggering lever 5 can be released in the case of agreement of the preadjusted and stopped time of day with a comparative time and from this point in time, the display of the time of day again runs continuously.

Such variations of the embodiment however do not change the principle of the servicing arrangement according to the invention.

With the proposed solution, an easily serviceable arrangement free of any doubts for the adjustment or correction of the wake-up time or of the time of day is made available, since changes in the time of day and wake-up alarm time are selected by different switches 6, 7. Moreover, the switch 22 enables the wake-up alarm time to be gated-in without having to shift the switch 7 and without the need for another control lever, since it makes use of the existing, easily accessible turn-off 5.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In an electronic alarm clock of the type including:
a digital display mechanism;
an alarm device;
a master circuit including:
an integrated control circuit having a counter for the time of day connected to said display mechanism, means for storing a wake-up alarm time, and means for comparing the wake-up alarm time to the time of day and being connected to the alarm device to activate the latter;
a main circuit connecting said counter and said display mechanism;
a gate-in circuit connecting said control circuit to said display mechanism for gating-in the wake-up alarm time onto said display mechanism;
manually operable selecting switch means connected to said master circuit for selecting a type of display to be adjusted;
a manually actuable alarm control switch for deactuating said alarm device;
a manually actuable triggering switch connected to said master circuit for adjusting the type of display selected by said switch means, the improvement wherein the improvement comprises:
said selecting switch means comprises first and second individually actuable switches, said first switch being connected for selecting types of wake-up alarm displays, such as hours, etc., for adjustment, and said second switch being connected for selecting types of time-of-day displays, such as hours, etc., for adjustment;
said switches being independently shiftable into various stop positions for selecting the type of display to be adjusted, and
said triggering switch, when actuated, being operable to adjust the value of a display selected by either of said first and second switches.

2. An electronic alarm clock as in claim 1, characterized in that said triggering switch including a button which is spring biased into a nonactuating position; said selecting switches comprising movable levers.

3. An electronic alarm clock as in claim 2, characterized in that the shifting path of each adjusting lever includes an additional stop position in the form of a base position in which no display is selected for adjustment.

4. An electronic alarm clock as in claim 1, characterized in that in the shifting path of the second adjusting switch at least four stop positions have been provided which the latter can assume in succession, namely one adjustment each for the recording of the hours, unit digit of minutes and tenths of minutes of the recording of the time of day, as well as a base position.

5. An electronic alarm clock as in claim 1, characterized in that the shifting path for the first adjusting switch includes at least three stop positions, namely one for the adjustment of the hours and one for the minutes of the display of the wake-up time, as well as a base position.

6. An electronic alarm clock as in claim 1 wherein the shifting path of each adjusting switch includes an additional stop position in the form of a base position in which no display is selected for adjustment; said gate-in circuit including a change-over switch disposed so as to be actuated by said first switch when the latter is shifted from its base position to gate-in the wake-up time for display onto the recording mechanism.

7. An electronic alarm clock as in claim 6 wherein said change-over switch is further disposed so as to be actuated by said alarm control switch, independently of said first switch, to gate-in the wake-up time on the recording mechanism.

8. An electronic alarm clock as in claim 1 wherein a gate-in switch is connected to said alarm control switch, said gate-in switch being operable to close a circuit interconnecting said display mechanism and said stored wake-up time in said control circuit to gate-in the wake-up time onto said display mechanism when said alarm control switch is placed in a preselected posture.

* * * * *